United States Patent [19]

Zacharias

[11] Patent Number: 4,704,938

[45] Date of Patent: Nov. 10, 1987

[54] MOUTH ORGAN

[75] Inventor: Ernst Zacharias, Trossingen, Fed. Rep. of Germany

[73] Assignee: Matt H. Hohner AG, Trossinger, Fed. Rep. of Germany

[21] Appl. No.: 947,622

[22] Filed: Dec. 30, 1986

Related U.S. Application Data

[63] Continuation-in-part of Ser. No. 721,388, Apr. 9, 1985, abandoned.

[30] Foreign Application Priority Data

Apr. 10, 1984 [DE] Fed. Rep. of Germany ..... 3413383

[51] Int. Cl.[4] ..... G10D 7/12

[52] U.S. Cl. ..... 84/377

[58] Field of Search ..... 84/377–379

[56] References Cited

U.S. PATENT DOCUMENTS 2,592,220 4/1952 Wetzler ..... 84/377

4,502,362 3/1985 Zacharias ..... 84/377

*Primary Examiner*—Lawrence R. Franklin

*Attorney, Agent, or Firm*—Chilton, Alix & Vankirk

[57] ABSTRACT

A mouth organ having suction-excited and pressure-excited reeds which cooperate with slotted plates is provided with a pair one-way of valve defining members formed from sheet material. The first valve member defining includes plural integral flaps which respectively act as individual valves to control air flow over associated suction-excited reeds. The second valve defining member is in the form of a single flap which is loosely disposed to move perpendicularly relative to the slotted plate with which the pressure-excited reeds cooperate.

8 Claims, 4 Drawing Figures

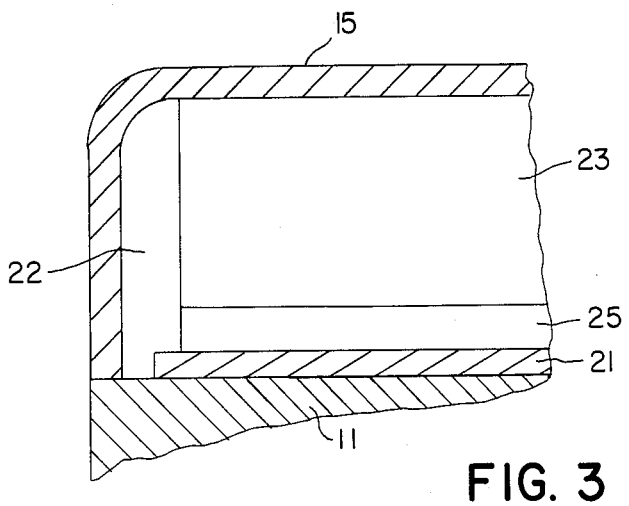
FIG. 3
FIG. 4
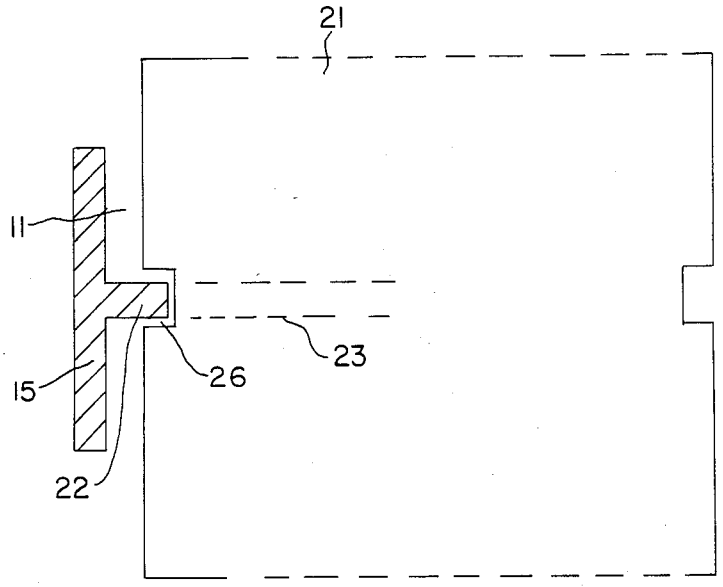

MOUTH ORGAN

This is a continuation-in-part of Ser. No. 721,388, filed Apr. 9, 1985, now abandoned.

BACKGROUND OF THE INVENTION (1) Field of the Invention

The present invention relates to musical instruments and particularly to that class of instrument known as the harmonica or mouth organ. More specifically, this invention is directed to improvements in hand-held musical instruments which produce sound in response to the passage of air over vibrating reeds and especially to air flow control valves for such instruments. Accordingly, the general objects of the present invention are to provide novel and improved apparatus of such character.

(2) Description of the Prior Art

It is known that the excitation of the reeds of a mouth organ may be facilitated by associating a one-way valve with each reed, the mouth organ being provided with both pressure-excited and suction-excited reeds. The valves function to reduce air loss through the gaps surrounding non-sounding reeds, i.e., about the suction-excited reeds when the player exhales and about the pressure-excited reeds when the player inhales. In known top-of-the-line mouth organs the number of valves will be equal to the number of reeds and the individual valves are adhesively secured to the slotted plates with which the reeds cooperate. The mounting of the valves is a time-consuming and thus expensive task. Accordingly, valves are frequently associated only with the lower frequency-producing reeds in the interest of the reduction of production cost. The foregoing is particularly true in the case of less expensive mouth organs such as those formed from molded plastic parts. A mouth organ comprised of molded plastic parts is disclosed in U.S. Pat. No. 4,502,362.

SUMMARY OF THE INVENTION

The present invention comprises an improved mouth organ having air flow control valves which are of a less complicated design and less expensive to manufacture when compared to the prior art. A mouth organ in accordance with the present invention is, because of its unique air control valve structure, relatively easy to assemble.

In accordance with the present invention a mouth organ will comprise only a pair of valve members. One of these valve members will be associated with the pressure-excited reeds while the other will be associated with the suction-excited reeds. The valve member associated with the pressure-excited reeds, in accordance with a preferred embodiment, comprise a first piece of sheet or film material disposed in an outlet plenum chamber located above a first slotted plate with which the pressure-excited reeds are integral. This piece of sheet material is freely movable perpendicularly in response to a pressure differential across the slotted plate. Accordingly, when the pressure in the voice channel or channels into which the musician directs air is higher than that in the outlet plenum chamber, the valve member will move away from the first slotted plate to define an open condition thus allowing excitation (vibration) of the pressure-excited reeds associated with the voice channels which have been pressurized.

Also in accordance with the present invention, the valve members associated with the suction-excited reeds are defined by a single piece of sheet material. This second valve defining sheet is generally comb-shaped with each "tooth" of the comb extending into a voice channel and overlying a slot in a second slotted plate through which air is drawn to excite a reed associated with that slot. The base portion of the second valve defining sheet is affixed, preferably by clamping, in the body of the mouth organ at the side thereof opposite to the voice channel openings through which the player forces or draws air during the playing of the instrument. Each individual tooth of the comb-shaped suction valve defining sheet is movable in response to a pressure differential across the slot which it covers.

The sheet material from which the valve members is formed is preferably a plastic having a thickness in the range of 0.1 to 0.3 mm. While polyvinylchloride has been found to be particularly well-suited for use in the present invention, other plastic materials may also be employed. Alternatively, the sheet material may also be selected from the group of materials comprising foam films, leather, felt and the like.

BRIEF DESCRIPTION OF THE DRAWING

The present invention may be better understood and its numerous objects and advantages will become apparent to those skilled in the art by reference to the accompanying drawing wherein like reference numerals refer to like elements in the two FIGURES and in which:

FIG. 3 is a partial section view in the direction shown by section line III—III in FIG. 1;

FIG. 4 is a schematic plan view of the sheet valve member and a portion of the structure shown in FIG. 3.

DESCRIPTION OF THE DISCLOSED EMBODIMENT

A mouth organ will conventionally have a first slotted plate which defines, on one side thereof, pressure-excited reeds. Also, a conventional mouth organ will have a second slotted plate with which the suction-excited reeds are integral. The integral reeds are in registration with the slots in their respective plates. The voice channels of the instrument are defined by the slotted plates and generally transversely oriented wall-like extensions thereof which are located to either side of and extend in the same direction as the reeds. Cover members are mounted on the instrument so as to define plenum chambers at the opposite side, in the direction of air flow, of the reeds with respect to the voice channels. These chambers are in communication with air flow openings through which air can be drawn into the instrument and exhausted from the instrument. The valves must be positioned so as to prevent air flow over the suction-excited reeds when the musician is forcing air into the instrument and to prevent air flow over the pressure-excited reeds when the musician is drawing air into the instrument.

Figure 1:
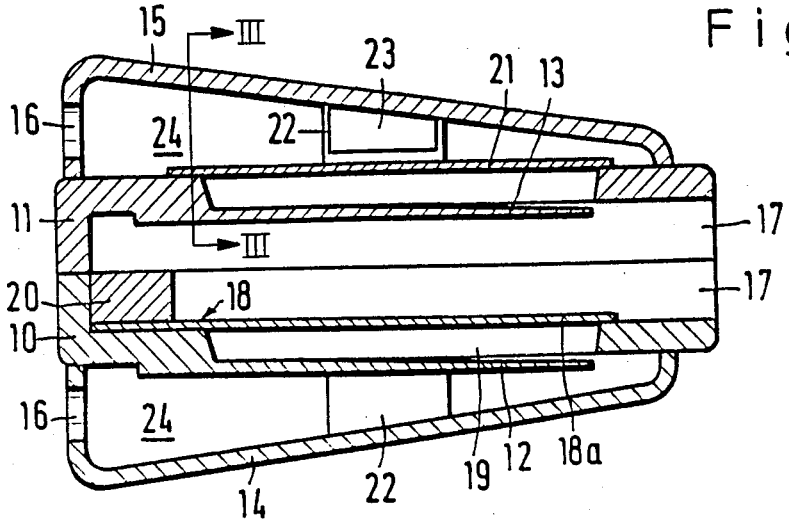
FIG. 1 is a cross-sectional side elevation view of a first embodiment of a mouth organ in accordance with the present invention.
Figure 2:
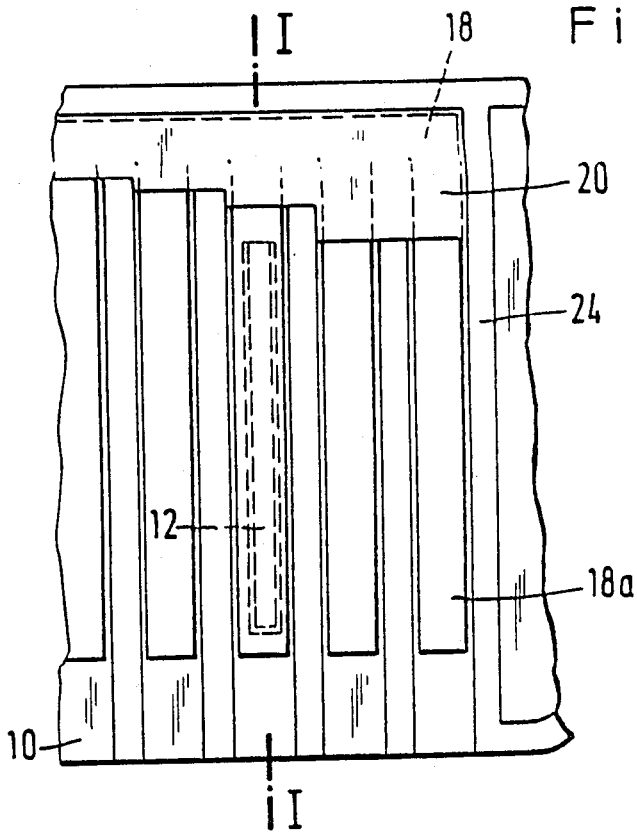
FIG. 2 is a partial plan view of the lower-half of the mouth organ of FIG. 1, FIG. 1 being a view which has been taken along section line I—I which is indicated on FIG. 2.

Referring now to the drawing, the mouth organ illustrated therein is comprised of molded plastic parts. The two molded "halves" of the body of the instrument are of slightly different design and are "welded" together to define the completed instrument. The lower half of the body of the disclosed embodiment is indicated at 10 while the upper half of the body is indicated at 11. The body halves 10 and 11 include the slotted plates with their integral reeds. Thus, the plate 10 is provided with slots 19 and a suction-excited reed 12 will be in registration with each of the slots 19. The suction-excited reeds 12, as may be seen from FIG. 2, are slightly spaced from the edges of their respective slots 19. As may be seen from FIG. 1, the distal end of each of reeds 12 is spaced from the slotted plate with which it is integral. In the case of the upper half of the body of the instrument, pressure-excited reeds 13 are integral with a slotted plate.

Cover members 14 and 15 are respectively mounted on the body halves 10 and 11 which define the slotted plates. The cover members 14 and 15 are provided with air flow openings 16. The cover members cooperate with the body halves to define plenum chambers 24. One or both of the body halves 10 and 11 include integral wall members 17 which are disposed between adjacent slots. In the disclosed embodiment wall members 17 are provided on both body halves are in abutting relationship as shown in FIG. 1 to define individual voice channels. Each of these voice channels is in communication, via a slot in a body half, with both of chambers 24. The pressure-excited reeds are actually disposed in respective voice channels while the suction-excited reeds are disposed in the lower or inlet plenum chamber 24 as the instrument is shown in FIG. 1. To summarize, a pair of reeds is associated with each voice channel and these reeds may be individually excited, as a result of the action of the valves to be described below, by either forcing air into or drawing air out of the associated voice channel.

The instrument as described above is substantially equivalent to that shown and claimed in U.S. Pat. No. 4,502,362 and the disclosure of this patent is hereby incorporated by reference.

In accordance with the present invention a first valve member, indicated generally at 18, is inserted into the lower half 10 of the body of the instrument. The valve member 18 has a generally comb-shaped contour with teeth 18*a* which extend into the voice channels so as to cover the slots 19. The wall members 17 which are integral with body half 10 do not extend to the rear interior wall of the body of the instrument and thus a space, which extends transversely with respect to the voice channels and wall members 17, is provided at the inwardly disposed ends of the voice channels. The base portion of the valve member 18 is located in this space and retained in position by a clamping member 20. The clamping member 20 is, in turn, retained in position by the wall members 17 which are integral with the body half 11, these wall members extending all the way to the ends of the voice channels. The clamping member 20 secures the valve member 18 in sealing fashion and the distal ends of the teeth 18*a* overlap the distal ends of respective suction-excited reeds 12. Air flow through the slots 19 associated with the suction-excited reeds is prevented by the flexible teeth 18*a* when the musician forces air into a voice channel or channels defined by the body halves 10 and 11. The foregoing results from the fact that each of the teeth 18*a* forms a one-way valve for its respective slot and these valves open only when the pressure in the voice channel is less than that in the inlet plenum chamber 24 into which the suction-excited reeds 12 extend. While each of the teeth 18*a* forms a valve which cooperates with a respective slot, the use of a single suction-valve member 18 with which all of these individual valves is integral facilitates construction and assembly of the instrument.

A second valve member 21 is provided for the pressure-excited reeds 13. The valve member 21 is a cut-out solid rectangle of sheet material which is disposed between the cover 15 and that portion of the upper half 11 of the body of the instrument which defines the upper slotted plate. The characteristics of the sheet material which forms valve member 21, and the manner in which the valve member 21 is captured in the chamber 24, are such that the entire valve member 21 may freely move perpendicularly with respect to the plane defined by the slotted plate associated with the pressure-excited reeds. The cover members 14 and 15 are spaced from the slotted plates by means of integrally formed webs 22 and, in the disclosed embodiment, valve member 21 is provided with apertures 26 through which the webs extend whereby the webs 22 act as guides for the movable valve member 21. The amplitude of the permitted movement of valve member 21, i.e., the distance the valve member may be lifted in response to the effect of a pressure differential to which it is exposed, is limited by stop members 23 which are also integrally molded with cover member 15. As shown in FIGS. 3 and 4, the solid sheet valve 21 lies horizontally above the upper body half 11. The apertures, or notches, 26 receive web members 22 to prevent significant horizontal displacement of the valve 21 relative to the body half 11 and associated pressure excited reeds 13 and slot. Stop member 23 descends from cover 15 and is spaced 25 above the valve 21. As shown in FIG. 1, the stop 23 need not extend the full dimension of the housing or valve 21.

The pressure-excited reeds are caused to vibrate by the musician forcing air into the voice channels. If the direction of air flow is reversed, i.e., during excitation of the suction reeds 12, the slots in the plate which is integral with the reeds 13 will be tightly sealed by valve member 21 which is pressed onto the upper side of the slotted plate by the pressure differential.

As may be seen from FIG. 2, the clamping member 20 preferably has a stepped contour so that the free, deflectable portion of each tooth 18*a* has approximately the same length as the suction-excited reed with which it is associated. The configuration of the clamping member receiving space defined by the wall members 17 on body half 10 will, of course, be complementary to the shape of the stepped clamping piece 20.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A mouth organ comprising:

means defining a body, said body defining means having a plurality of generally parallel wall members which define therebetween individual voice channels, said body defining means further having first and second plates extending generally parallel to each other and bridging said wall members, each of said plates having a slot therethrough in registration with one of said voice channels;

a plurality of pressure-excited reeds, said pressure-excited reeds being mounted so that individual of said pressure-excited reeds are disposed in front of respective slots in the first of said body defining means plates, said pressure-excited reeds being positioned within said voice channels;

a plurality of suction-excited reeds, said suction-excited reeds being mounted so that individual of said suction-excited reeds are disposed in front of respective slots in the second of said body defining means plates, said suction-excited reeds being positioned outside of said voice channels;

cover means, said cover means cooperating with said body means so as to define an outlet plenum chamber at the side of said slots in said body defining means first plate disposed oppositely to said voice channels and an inlet plenum chamber at the side of said slots in said body defining means second plate disposed oppositely to said voice channels;

first valve means for controlling air flow through said slots in said second plate of said body defining means, said first valve means being comprised of flexible sheet material and having a generally comb-shaped contour with a base portion and integral teeth extending therefrom, said first valve means being positioned such that each of the teeth which define said comb-shaped contour extends into one of said voice channels in overlapping relationship to a slot in said second plate, said first valve means teeth being disposed at the opposite ends of said slots with respect to suction-excited reeds; and second valve means, said second valve means being formed of a single rectangularly shaped solid piece of sheet material and being positioned in said outlet plenum chamber, said second valve means cooperating with the slots in said body defining means first plate, said second valve means being disposed at the ends of said slots opposite to said pressure-excited reeds and being freely movable perpendicularly with respect to the plane defined by the pressure-excited reeds;

whereby when pressurized air is forced into the voice channels said second valve means is lifted from said first plate to open the slots in the first plate and when air is drawn from the voice channels said second valve means is drawn against said first plate to cover and seal the slots therein.

2. The mouth organ of claim 1 wherein said second valve means is provided with at least one aperture and wherein said mouth organ further comprises at least one web guide located in said outlet plenum chamber said web guide engaging said aperture to restrict lateral movement of said second valve means.

3. The mouth organ of claim 2 further comprising:

at least one stop member disposed in said outlet plenum chamber for limiting the perpendicular motion of said second valve means.

4. The mouth organ of claim 1 further comprising:

at least one stop member disposed in said outlet plenum chamber for limiting the perpendicular motion of said second valve means.

5. The mouth organ of claim 1 wherein said first valve means comprises a valve member clamped within said body defining means.

6. The mouth organ of claim 5 wherein said body defining means is comprised of a pair of moulded body halves and wherein said reeds are integral with the portions of said halves which define said slotted plates.

7. The mouth organ of claim 6 further comprising:

at least a first stop member disposed in said outlet plenum chamber for limiting the perpendicular motion of said second valve means.

8. The mouth organ of claim 7 wherein said second valve means is provided with at least one aperture and wherein said mouth organ further comprises at least one web guide located in said outlet plenum chamber, said web guide engaging said aperture to restrict the lateral movement of said second valve means.

* * * * *

UNITED STATES PATENT AND TRADEMARK OFFICE

CERTIFICATE OF CORRECTION

PATENT NO. : 4,704,938

DATED : November 10, 1987

INVENTOR(S) : Ernst Zacharias

It is certified that error appears in the above-identified patent and that said Letters Patent is hereby corrected as shown below:

On the front page of the patent, the entry for Assignee is revised to read: Matth. Hohner AG, Trossingen, Fed. Rep. of Germany Signed and Sealed this Seventeenth Day of May, 1988

*Attest:*

*Attesting Officer*

DONALD J. QUIGG

*Commissioner of Patents and Trademarks*